United States Patent [19]

Tertinek

[11] Patent Number: 4,595,384

[45] Date of Patent: Jun. 17, 1986

[54] MECHANISM FOR MAINTAINING CONSTANT BELT TENSION ON SHEAVES WITH A NON-FIXED CENTER DISTANCE

[76] Inventor: Christian T. Tertinek, 3301 Cheshire Rd., Canandaigua, N.Y. 14424

[21] Appl. No.: 616,164

[22] Filed: Jun. 1, 1984

[51] Int. Cl.[4] ..... F16H 7/10

[52] U.S. Cl. ..... 474/112

[58] Field of Search ..... 474/112, 148

[56] References Cited

U.S. PATENT DOCUMENTS 4,311,120 1/1982 Freyn et al. ..... 474/112 X

*Primary Examiner*—James A. Leppink
*Assistant Examiner*—Frank Mc Kenzie
*Attorney, Agent, or Firm*—Harvey B. Jacobson

[57] ABSTRACT

A mechanism which maintains drive belt tension substantially constant when the drive belt is mounted on sheaves with a non-fixed center distance such as the sheaves and belt utilized in vibratory earth compaction equipment, shakers and the like where off-centered weights are rotated at high speeds to obtain desired vibrations. The mechanism includes a driven sheave that is mounted eccentrically on the rotating shaft which supports the off-center weight with the eccentricity of the eccentrically mounted sheave being in the same direction as the offset of the off-center weight. This arrangement allows the center distance between the drive sheave and driven sheave to remain relatively constant thus retaining the drive belt tension relatively constant.

7 Claims, 3 Drawing Figures

MECHANISM FOR MAINTAINING CONSTANT BELT TENSION ON SHEAVES WITH A NON-FIXED CENTER DISTANCE

BACKGROUND OF THE INVENTION

1. Field of the Invention

The present invention generally relates to a structural arrangement enabling substantially constant belt tension to be maintained on a drive belt which encircles and drivingly interconnects a drive pulley or sheave and a driven pulley or sheave in which the center-to-center distance between the pulleys or sheaves is not fixed, that is, one of the sheaves or pulleys can move in relation to the other during operation of the mechanism with which the sheaves and belt are associated. More specifically, the invention relates to the unique mounting of the driven sheave or pulley eccentrically with respect to a rotating shaft having an off-center weight thereon which is driven at a high speed to impart vibratory forces to a structure which supports the shaft, such as an earth compacting device, shaker or the like in which the eccentricity of the eccentrically mounted driven pulley or sheave is offset in the same direction as the off-center weight in order to maintain a more constant center-to-center distance between the sheaves or pulleys and thus maintain a more constant tension on the drive belt.

2. Description of the Prior Art

Many devices utilize off-centered weights that are rotated at high speeds to obtain vibration. Among such devices are shakers, vibratory earth compactors and the like which are usually driven by electric motors, internal combustion engines or the like having a single or multiple groove pulley or sheave on the output shaft that is engaged by one or more V-belts which correspondingly engage a corresponding pulley or sheave on the shaft having the off-center weight mounted thereon or associated therewith. In order to obtain long engine life, the motor or engine is usually mounted on a vibration isolator so that the engine and the drive sheave on the output shaft remains relatively stationary while the driven sheave or pulley on the shaft having the eccentric weight thereon vibrates or moves at a predetermined frequency and amplitude depending upon the particular application or use of the vibratory force. With this arrangement, the center-to-center distance between the pulleys or sheaves changes with the drive belt or belts having to accommodate this variation in center-to-center distance which causes undue stress, premature failure and at times the belts will not stay on the pulleys or sheaves. The following U.S. Pat. Nos. are relevant to this invention.

2,632,334
2,876,616
2,994,216
3,396,988
3,883,260

Heckner U.S. Pat. No. 3,883,260 utilizes an off-center motor to actually create the vibration which is a different concept from this invention. Austin U.S. Pat. No. 2,876,616 discloses a sprocket 28 which is off-center but this eccentricity creates varying speed on the driven sprocket 25 which is advantageous in the yarn forming industry but is not equivalent to this invention. Morton U.S. Pat. No. 2,994,216 discloses a spring-loaded idler which will retain a substantially constant pressure on the drive belts but is not pertinent to this invention. Kroening U.S. Pat. No. 3,396,988 discloses eccentric sprockets for taking up slack and backlash which is not related to this invention. The other patents mentioned above also fail to disclose any structure equivalent to this invention.

SUMMARY OF THE INVENTION

An object of the present invention is to provide a mechanism for maintaining constant belt tension on sheaves with a non-fixed center distance in which the driven sheave is mounted on a rotating shaft having an off-center weight which causes vibration of the device on which the shaft is mounted during high speed rotation of the shaft and thus causing variation in the center-to-center distance between the drive and driven sheaves and variation in belt tension during such movement with the present invention specifically providing an eccentrically mounted driven sheave in which the eccentricity of the driven sheave is in the same direction as the off-center weight on the shaft in order to maintain the center-to-center distance between the sheaves at a substantially constant distance thereby maintaining more constant tension on the drive belt interconnecting the drive and driven sheaves.

Another object of the invention is to provide a mechanism in accordance with the preceding object in which the eccentricity of the driven sheave and thus the eccentric forces formed during high speed rotation of the driven sheave will vary in accordance with the eccentric weight on the shaft allowing the center-to-center distance between the sheaves to remain relatively constant with the specific orientation being dependent upon the amount of eccentric weight on the shaft, the speed of rotation, the mass of the system and the spring constant of the vibration isolators and the dampening effect within the system.

A further object of the invention is to provide a mechanism in accordance with the preceding objects in which the eccentrically mounted sheave provides a relatively inexpensive solution to the problem of varying belt tension thereby relieving the belt of undue stress and resultant premature failure and eliminating problems of the belt becoming disengaged from one of the sheaves during variation in the center-to-center distance of the sheaves.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
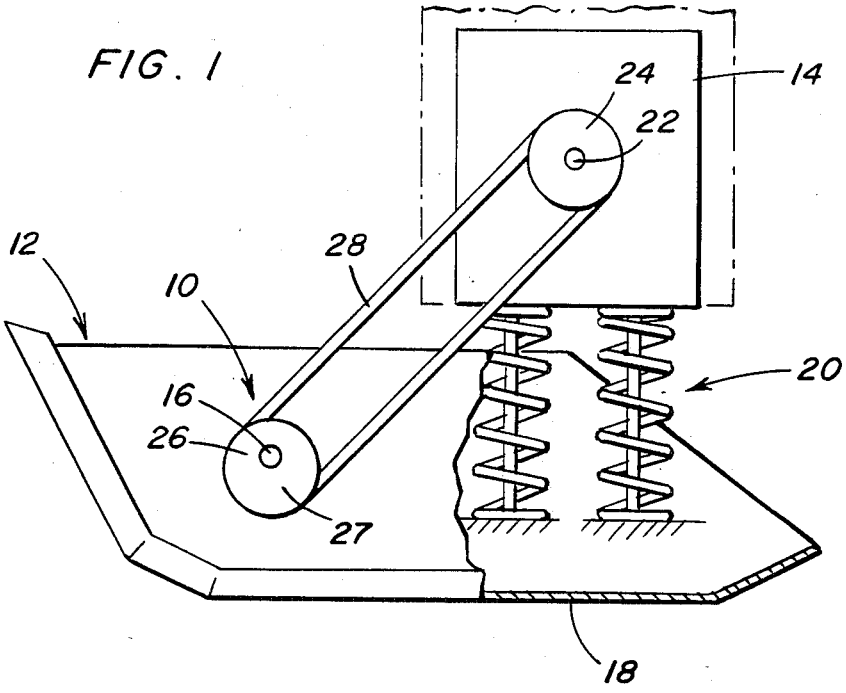
FIG. 1 is a schematic side elevational view of the mechanism of the present invention in its association with the components of a vibratory earth compacting unit.
Figure 2:
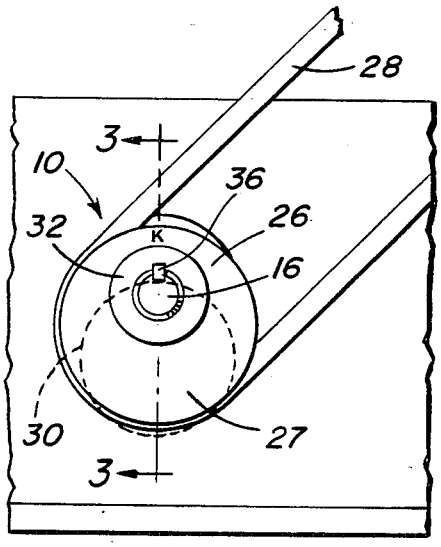
FIG. 2 is a side elevational view of the eccentrically mounted sheave.
Figure 3:
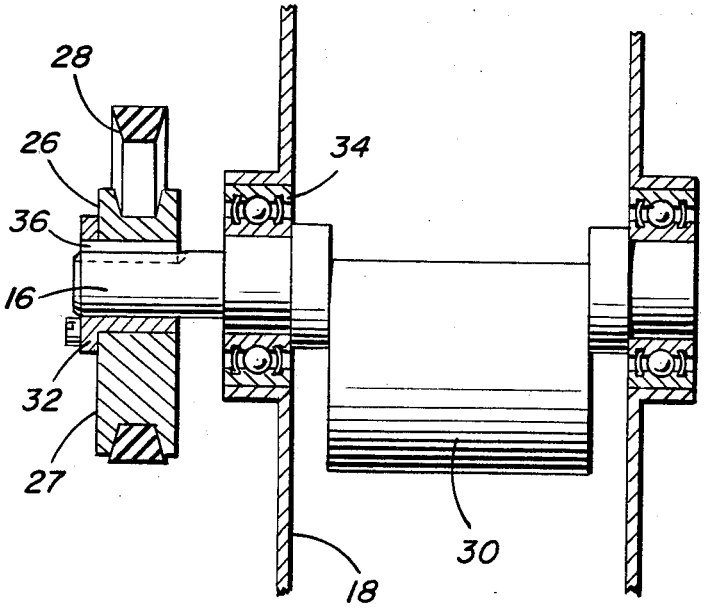
FIG. 3 is a sectional view taken generally along section line 3—3 on FIG. 2 illustrating the eccentrically mounted sheave and the shaft with the off-center weight thereon.

Referring now specifically to the drawings, the mechanism of the present invention is generally designated by reference numeral 10 and is associated with a vibratory earth compacting unit generally designated by the numeral 12 which includes an engine or motor 14 drivingly connected to an off-centered weight shaft 16 supported by a compacting plate unit 18 for vibratory movement when the shaft 16 is rotated at high speed. The engine 14 is supported by vibration isolators 20 in the form of coil springs or the like and suitable dampening devices of conventional construction so that the engine 14 will remain relatively stationary while the compacting plate or other vibratory unit will vibrate. The motor 14 includes an output shaft 22 having a sheave 24 mounted thereon in aligned relation with a sheave 26 on the shaft 16 with a drive belt 28 encircling the sheaves 24 and 26 and transmitting driving force from the output shaft 22 to the off-centered weight shaft 16. During high speed rotation of the shaft 16, the off-center weight 30 attached thereto or formed therein will cause vibration of the compacting plate 18 in a well known manner and during such vibration, the center-to-center distance between the output shaft 22 or the center of the sheave 24 and the shaft 16 and the rotational axis of the sheave 26 will vary when the center of the sheave 26 and the center of rotation of the shaft 16 coincide.

In this invention, the sheave 26 is mounted eccentrically with respect to the rotational axis of the shaft 16 as illustrated in the drawings with the sheave 26 being mounted on the shaft 16 through a bushing 32 of conventional construction. As illustrated, the shaft 16 is rotatably journaled in bearing supports 34 that are fixed to the side walls of the compactor plate 18 in any suitable manner so that as the eccentric weight 30 rotates, the compactor plate 18 will vibrate in a well known manner. As illustrated, the eccentric portion 27 of the sheave 26 is offset to the same side of the axis of rotation as the eccentric weight 30 on the shaft 16, that is, when the eccentric portion 27 is located below the shaft 16, the eccentric weight 30 will also be oriented below the shaft 30. The flanged bushing 32 and shaft 16 are provided with matching grooves forming a keyway to receive a key 36 in a conventional manner and bolts 38 secure the bushing 32 to the pulley 26 which has a "K" inscribed thereon so that alignment of the key 36 and keyways therewith will assure proper orientation of the off-center portion 27 of the pulley 26 in alignment with the off-center weight 30 in the same offset relattion to the shaft 16. By utilizing the eccentrically mounted or off-center sheave 26 on the shaft 16 having the off-center weight 30 associated therewith, tension on the drive belt 28 will remain relatively constant without the use of spring-loaded idler pulleys and the like which do not perform adequately especially at high speeds such as used in this type of equipment.

In one practical embodiment of this invention, the off-center sheave 26 is utilized on a vibratory earth compactor which has an eccentric force of 10,000 pounds and vibrates at 4,500 vibrations per minute. In this particular arrangement, the hole in the sheave 26 which receives the shaft 16 is offset 0.2 inch in the same direction as that in which the off-center weight 30 is off-center. The specific dimensional relationships will vary with there being a certain amount of offset with relation to its center and oriented in a specific way with respect to the eccentric weight on the eccentric weight shaft so that the center-to-center distance between the shaft 22 and thus the center of the sheave 24 and the center of the sheave 26 will remain relatively constant. The amount of offset and relationship of this offset to the eccentric weight depends on the amount of the eccentric weight 30, the speed of rotation of the shaft 16, the mass of the system and the spring constant of the vibration isolators 20 and the dampening effect within the system. Also, while a single groove sheave or pulley assembly is illustrated and a single drive belt is illustrated, the concept of this invention may be used with multiple groove pulleys and the like. Also, this concept may be used in association with other vibratory equipment such as shakers and the like in which the center-to-center distance between the sheaves is non-fixed and excessive variation in belt tension occurs.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mechanism for maintaining substantially constant belt tension on sheaves having a non-fixed center distance during rotation comprising a drive sheave and a driven sheave drivingly interconnected by a belt, said driven sheave being connected to an off-center weighted shaft supported by a vibratory member in which relative movement between the centers of the sheaves enables excessive belt tension variation, said mechanism comprising the mounting of the driven sheave eccentrically to the shaft with the eccentric portion of the driven sheave being offset in the same direction as the off-center weight on the shaft to maintain the center-to-center distance between the center of the sheaves more constant thereby maintaining belt tension more constant.

2. The mechanism as defined in claim 1 wherein said drive sheave is connected to an output shaft of a power device supportingly connected with the vibratory member by vibration isolators to enable the power source to remain relatively immovable during vibratory movement of the vibrating member.

3. The mechanism as defined in claim 2 wherein said vibrating member is an earth compacting plate, said shaft being rotatably supported from the plate for vibrating the plate when the shaft is rotated, said eccentric sheave including a keyway associated with a keyway on the shaft to receive a key for securing the sheave non-rotatably to the shaft, said sheave including a replaceable bushing having the keyway therein enabling the angular relation of the offset portion of the sheave to be varied in relation to the shaft.

4. In combination with a vibratory earth compacting unit having a vibrating member engaging the earth to be compacted, a shaft journaled on the vibrating unit, an off-center weight rigid with the shaft for vibrating the vibrating member during rotation of the shaft, a motor, vibration isolator means supporting the motor from the vibrating member to isolate the motor from vibrations, drive means interconnecting the motor and shaft, said drive means including a sheave driven by the motor, a driven sheave on the shaft and a flexible belt encircling and drivingly interconnecting the sheaves, the improvement comprising the driven sheave being eccentrically mounted on and movable with said shaft with the offset weight with the eccentric portion of the driven sheave being offset in the same direction as the offset weight wherein the offset weight is oriented to one side of the rotational axis of the shaft and the eccentric portion of the driven sheave is oriented to the same side of the rotational axis.

5. The combination as defined in claim 4 wherein the eccentricity of the driven sheave is determined by the weight of the off-center weight, the speed of rotation of the shaft and the spring constant of the vibration isolating means.

6. A drive mechanism comprising a pair of generally parallel shafts supported for rotational movement, pulley means on each of said shafts, belt means encircling the pulley means for transferring rotational torque between said shafts, one of said shafts being powered and the other of said shafts being driven by the belt means, said driven shaft being rotatably supported for movement transversely of the rotational axis thereof and having eccentric weight means associated therewith to cause cyclic movement of the shaft transversely of its rotational axis during rotation thereof, said powered shaft being supported for rotational movement in a manner to preclude transverse movement in relation to its rotational axis within the drive mechanism with the pulley means being concentric with the powered shaft, means eccentrically mounting the pulley means on the driven shaft with the eccentric portion thereof offset to maintain a more constant tension in the belt means when transferring torque by maintaining a more constant distance between the centers of the pulley means during relative movement of the rotational axis of driven shaft and powered shaft during rotation thereof due to said eccentric weight means.

7. The driven mechanism as defined in claim 6 wherein said driven shaft is rotatably supported by a vibratory member and the powered shaft is rotatably supported by a power unit, said power unit and vibratory member being movable in relation to each other, said means mounting the pulley means eccentrically on the driven shaft including means to enable adjustment in the offset relation of the eccentric portion of the pulley means to the eccentric weight means with the eccentric portion of the pulley means being offset in the same direction as the eccentric weight means with respect to the rotational axis.

* * * * *